United States Patent [19]

Goodman

[11] Patent Number: 4,524,560

[45] Date of Patent: Jun. 25, 1985

[54] CASE TOP FOLDER AND FLAP SUPPORTER

[75] Inventor: James A. Goodman, Glencoe, Ill.

[73] Assignee: Prototype Equipment Company, Deerfield, Ill.

[21] Appl. No.: 414,638

[22] Filed: Sep. 3, 1982

[51] Int. Cl.[3] ..... B65B 7/20

[52] U.S. Cl. ..... 53/374

[58] Field of Search ..... 53/491, 374, 375, 383, 53/387, 492

[56] References Cited

U.S. PATENT DOCUMENTS

| | | | |
|---|---|---|---|
| 1,916,515 | 7/1933 | Kraft | 53/374 X |
| 2,068,242 | 1/1937 | Maxwell | 53/374 X |
| 2,435,878 | 2/1948 | Dunning | 53/491 |
| 2,654,981 | 10/1953 | Stenger | 53/374 |
| 3,485,008 | 12/1969 | Silver | 53/491 |
| 4,215,522 | 8/1980 | Clift et al. | 53/374 X |

*Primary Examiner*—Horace M. Culver

*Attorney, Agent, or Firm*—Willian Brinks Olds Hofer Gilson & Lione, Ltd.

[57] ABSTRACT

A case top folder and flap supporter is disclosed having a pair of folding arms each disposed at one side and near the top of the case and mounted for pivotal movement from a vertical position to a horizontal position over the case so as to urge a pre-glued first set of flaps into a closed position spanning the top of the case. Fixed at the end of each such folding arm is an engaging means comprising in one form a depending hook-like projection with a concavity, and in another form a sawtooth edge, each of which is operable to engage the outer edge of a flap while such flap is being folded to the closed position. In the flap closed position the folding arms support the first flap set by maintaining engagement with the flap outer edges so that a second flap folding assembly, which comprises a pair of pre-break folding arms and a platen, can descend from above the case to fold the second flap set over and press the same into contact with the supported first flaps until the glue is set. The first flap folding arms are laterally movable a small distance so that the outer edge of each first flap is released from the engaging means whereby the first flap set folding arms can be pivoted upwardly away from the case.

11 Claims, 12 Drawing Figures

128a
128
2.
68
72a
72
70
56a
56
84
54
86a
86
54a
126a
126
32a
5
38
36
32
52
30a
34a
92
83
34
30
58
82
10a
10
22
14a
14
88
80
16a
16
54a
17a
12a
12
17
18a
24a
24
54
18
40a
44a
44
26
20
42a
42
40
46a
46
51
48
50
50
5
51
2.

CASE TOP FOLDER AND FLAP SUPPORTER

BACKGROUND OF THE INVENTION

The present invention relates generally to equipment for closing cases containing goods for shipment, and particularly to that type of equipment adapted for folding the top flaps of such cases to overlapping closed positions.

In automated assembly line packaging techniques, there remains a need to quickly and efficiently fold the flaps of square or rectangular-shaped cases to a closed position and maintain that position for a period of time sufficient to allow the glue, which has been previously applied to certain flap surfaces, to set. The case may then be advanced in the assembly line for further processing or shipment.

Conventional packaging cases which are in widespread use are generally rectangular in shape and include sets of top and bottom flaps. After having been erected from a blank into a box-like configuration, glue is applied to specified surfaces of the bottom flaps which are then folded and held in that position until the glue is set. This process can be carried out either manually or by machine and is not overly difficult since the case is empty at this stage and pressure can be applied from above and below so as to sandwich the bottom flaps in the closed position until it is assured that the glue is set. A machine specially adapted for erecting a folded blank into a box configuration, applying glue to the bottom flaps and folding the same, is fully disclosed in my copending application by James A. Goodman, U.S. Ser. No. 371,945 filed Apr. 26, 1982, and assigned to the assignee of the present invention.

The process of closing the case top is, however, not as easily accomplished. Equipment access from inside the erected case, to hold the top flaps sandwiched together in a closed position, is precluded. If the contents fill the erected case to the top, and if such contents are solid, external pressure from above alone may be effective to press the top flaps against such contents until the glue is sufficiently dried. Such an unpredictable arrangement is unacceptable for high-speed commercial sealing operations. Without predictable supporting during the glueing operations, the top flaps cannot be sealed effectively in that fashion.

The present invention is especially advantageous in situations where the contents of the case are fragile, such as packages of coffee, potato chips or popcorn, and when the contents, whether fragile or otherwise, do not fill the entire volume of the case. The present invention permits one set of flaps, such as the top minor flaps, to be folded to a closed position and supported there while the other flaps, such as the major flaps, are folded and firmly pressed down on the glued minor flaps until such glue is set. Moreover, the first set of flaps are supported in this closed position from above the case without interfering with the closing of the top flaps thereover. Other advantages and features of the invention will become apparent by referring to the detailed description of the invention.

SUMMARY OF THE INVENTION

In accordance with the invention, there is provided apparatus and methods for closing and supporting the top flaps of a case. Particularly, there is employed a pair of flap folding arms disposed generally to the side and above the case and mounted for pivotal movement from a vertical position to a horizontal position. The downward movement of the arms to the horizontal position is effective to fold one set of top flaps, preferably the minor flaps, to a closed position.

At the end of each flap folding arm, there is fixed a depending projection with an engagement means which becomes engaged with the outer edge of the flap as the arm is pivoted to the horizontal position. Each arm is maintained in this position so as to support the end of each adjacent flap.

In folding and closing the other flaps, a platen situated above the case is moved downwardly toward the case. A pair of slotted pre-break arms are slidably mounted to the platen such that downward platen movement causes each such pre-break arm to arcuately move and fold the other flaps to a partially closed position.

The platen continues its downward movement and completes the folding of these other flaps over and in contact with the first pair of supported flaps. The platen includes a pair of slots to accommodate the flap folding arms therein so that the platen can press downwardly on the case top while the flap folding arms are also horizontally positioned upon the case to support the associated flaps.

After the glue is set, each flap arm is disengaged from its respective flap edge by being laterally moved away from such edge and pivoted upwardly and away from the case. Simultaneously, the platen is raised whereby the case can be advanced in the assembly line.

In the preferred embodiment, the invention includes means for vertically repositioning the operating position of the platen, as well as means for horizontally repositioning the operating position of the flap folding arms to accommodate cases of various sizes and shapes.

BRIEF DESCRIPTION OF THE DRAWINGS

Further features and advantages of this invention will become apparent from a description of an illustrative embodiment where the flap folding arms are engageable with the top minor flaps of a rectangular carton, as shown in the following drawings wherein.

DETAILED DESCRIPTION OF THE INVENTION

The environment in which the present invention has particular utility is fully disclosed in my co-pending application as identified above. It should be appreciated at the outset that the present invention may be utilized as a stand-alone machine in an assembly line, or the principles thereof can be incorporated in the equipment which erects the case blank and fills it with goods. In this manner, the case can be formed, filled and glued and sealed at a single station in the assembly line. The invention is also adaptable to different shapes and sizes of cases. For ease of description and clarity of understanding, the invention will be described herein as a stand-alone operation. The illustrated machine is also designed for use with rectangular cases having sets of major and minor flaps, and where the major flaps fold over the minor flaps. For purposes of the following description, it will also be assumed that the case is filled with goods and ready for closing the top thereof.

Figure 1:
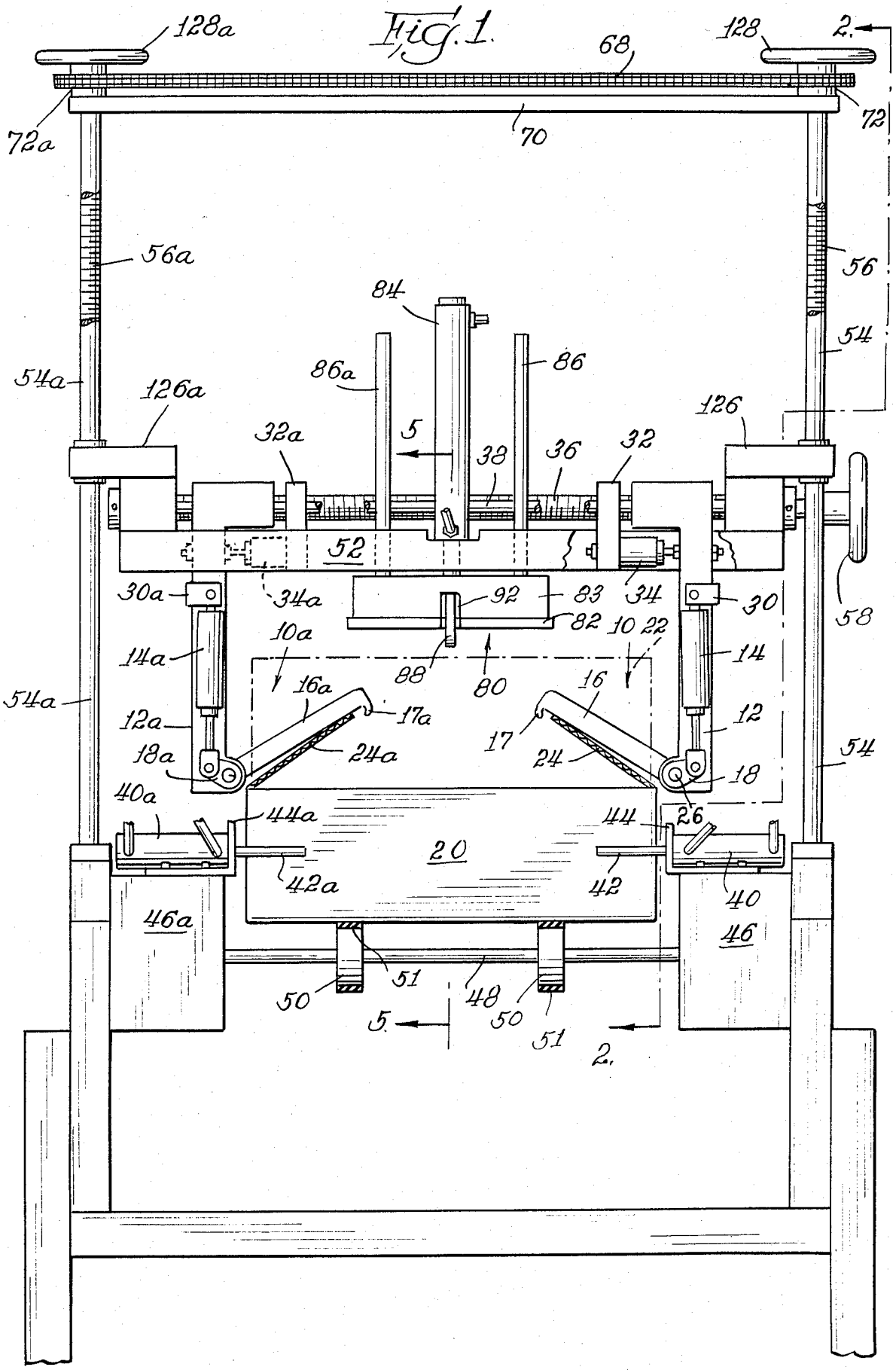
FIG. 1 is a front view of the case top sealer illustrating the top flap folding assemblies.

Turning now to FIG. 1, there is shown the front of a case 20 whose top flaps are being folded by a minor flap folding assembly and a major flap folding assembly, generally designated 10 and 80, respectively. Many parts of the invention described below function in pairs. It should be understood that the part not specifically described is identical in structure and operation to the part described and thus will not be mentioned except by occasional reference to its element number. For instance, the minor flap folding assembly 10 functions in concert with that of 10*a*, each performing the identical operation of closing a respective minor flap 24 and 24*a* to a closed position. For each apparatus element having an alphameric designation, there exists other identical apparatus which is complementary in structure and operation.

According to the illustrated embodiment of the present invention, the case 20 is advanced broad side forward on a conveyor transport 50 until stopped by the piston 42 of a conveyor cylinder 40. In this fashion, the case is presented to the case top sealer with the minor flaps disposed on the sides of the case. As a case 20 is advanced on the conveyor, the minor flap folding arms 16, 16*a*, are initially in a vertically upright position. In this manner the case 20, with its vertically-oriented minor flaps 24 and 24*a* and major flaps 22 (shown in phantom) is transported unimpeded by the invention until stopped by the conveyor cylinder 40.

For clarity, the driving mechanisms of the various cylinders are not shown. It is well within the capability of those skilled in the art to implement a timing system for systematically controlling a group of valves to supply pressurized air or fluid to any one of the cylinders to accomplish the overall function of the invention described below. In the preferred embodiment, each cylinder is of the double-acting air pressure type.

Figure 6:
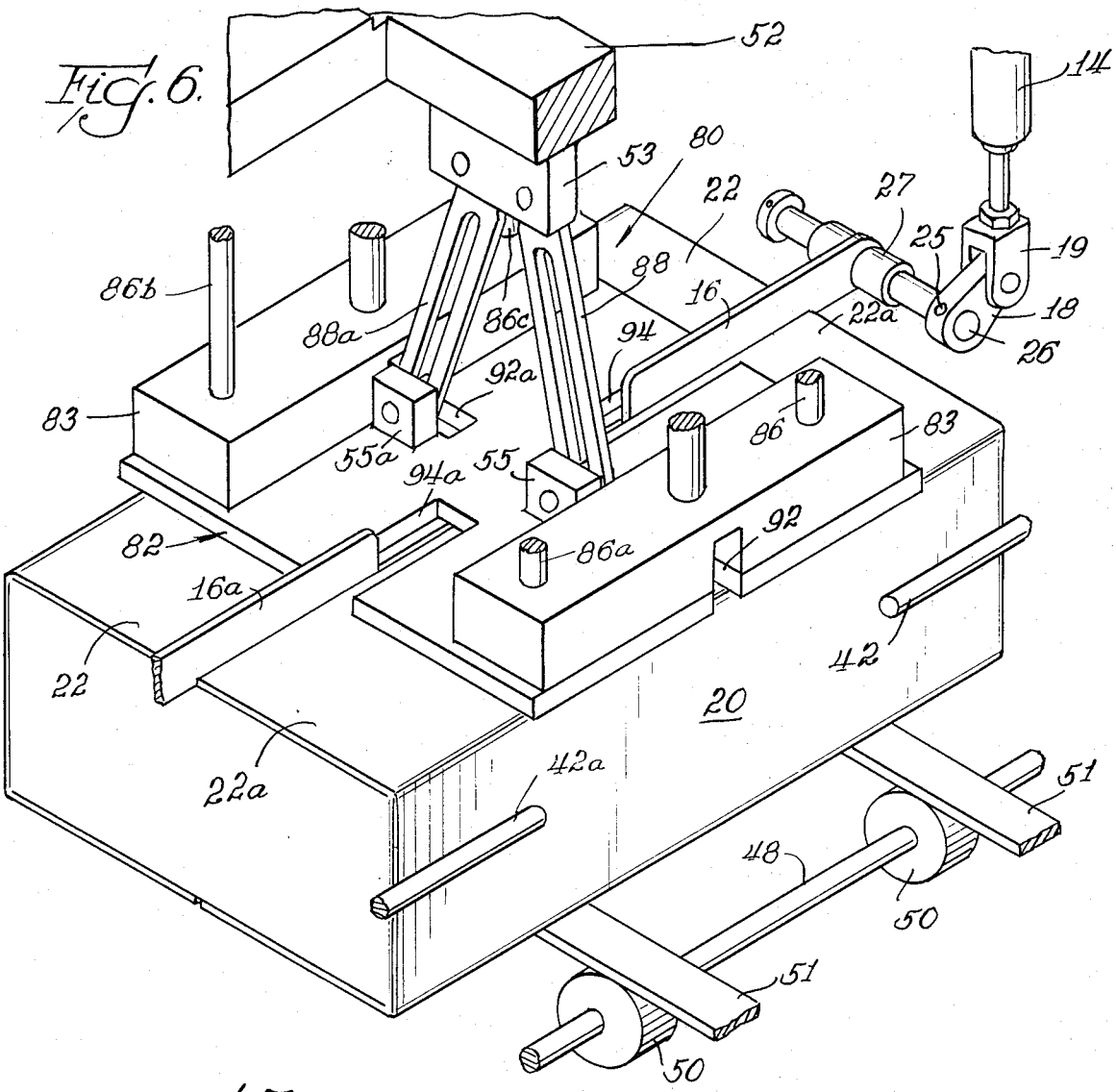
FIG. 6 is an isometric view illustrating the first folded flaps of the case being supported by the minor flap folding arms, while the second folded flaps are pressed thereonto by the platen assembly.

The minor flap folding assembly 10 includes a bifurcated frame 12 movable laterally. One end of a folding arm cylinder 14 is pivotally anchored to the bifurcated frame by a pin 28 extending through the cylinder end and into a frame bracket 30. This pinned arrangement allows slight pivotal movement of the cylinder occasioned by its piston reciprocating a bell crank 18. A minor flap folding arm 16 is journaled for pivotal movement in the frame 12 by an axle shaft 26. A bell crank 18 is suitably secured to the axle shaft 26 by a quick release pin (not shown). The lever arm of the bell crank 18 is connected to the piston of cylinder 14 by a clevis 19 (FIG. 6). With this structure, the extension and retraction of the cylinder 14 piston produces a corresponding pivotal movement of the folding arm from a respective initial vertical position to a horizontal position.

Figure 2:
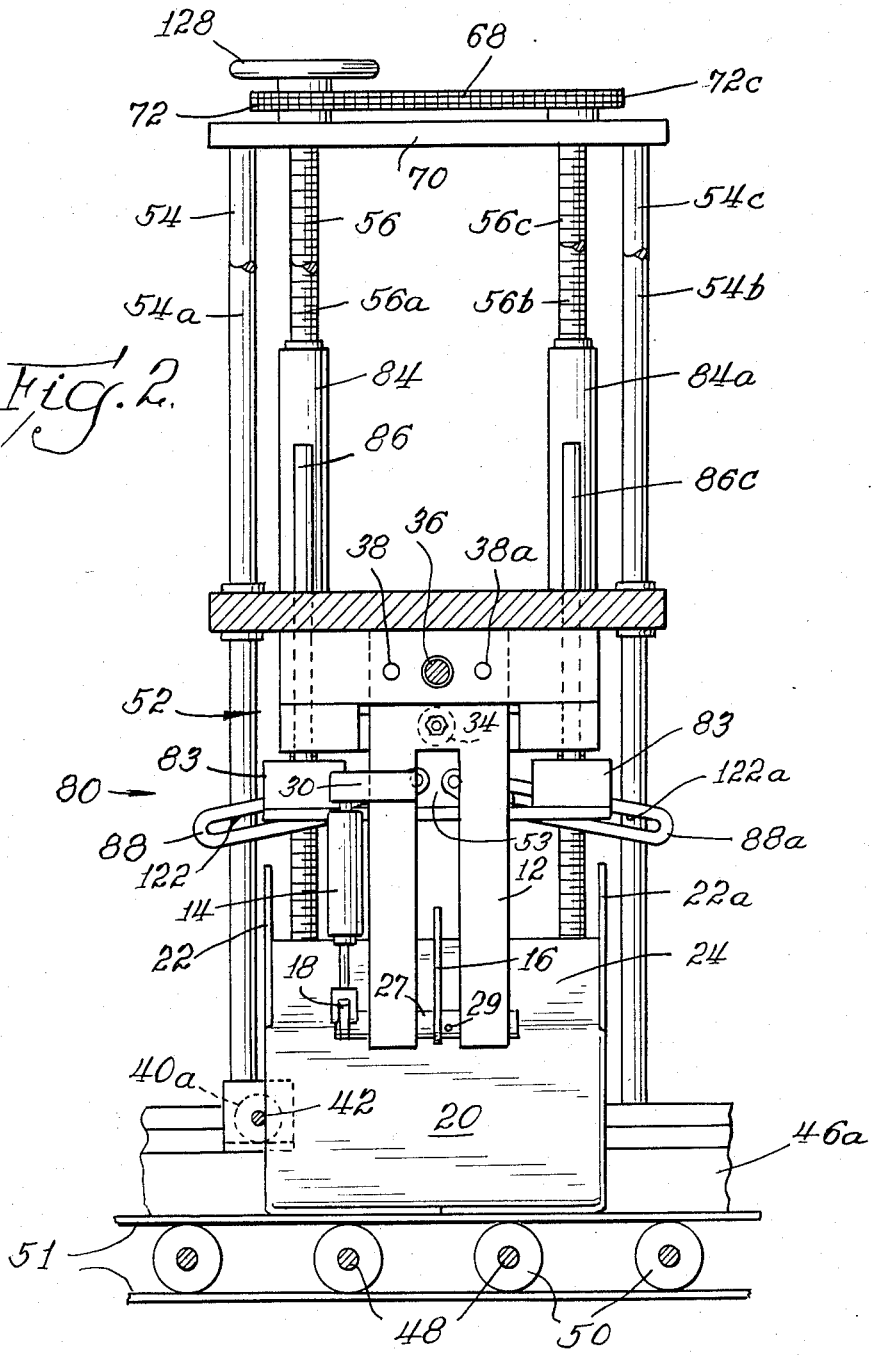
FIG. 2 is a side view of the case top sealer taken along line 2—2 of FIG. 1.

The bifurcated frame 12 is movable laterally by the action of a release cylinder 34. The release cylinder base is fixed to a bracket 32 while the piston shaft is fixed to the bifurcated frame 12. The bracket 32 is threaded onto the worm drive 36 and is thereby laterally adjustable by the rotation of such drive. The bifurcated frame 12, on the other hand, is not threated on the worm drive, but rather is slideable laterally on a pair of horizontal guide rods 38 and 38*a* (FIG. 2). Such guide rods also pass through the threaded bracket 32 to prevent it, as well as the bifurcated frame 12, from rotating about the worm drive 36. By use of the structure just described, the extension and retraction of the release cylinder 34 piston moves the bifurcated frame 12 and thus the minor flap folding arm 16 laterally. The stroke of the piston for the release cylinder 34 is preferably short, i.e., about one-half inch. The significance of moving the minor flap folding arm 16 laterally by this small amount will be discussed below in connection with the disengagement of the hooked projection 17 from the minor flap outer edge.

The details of the major flap folding asembly, generally designated 80, will be discussed in connection with FIGS. 5*a*–5*c*. However, FIGS. 1 and 2 show that the pistons of a pair of platen drive cylinders 84 and 84*a* drive a platen 82 upwardly and downwardly. A reinforcing member 83 bordering two edges of the platen 82 provides a base for fastening thereto the pistons of the platen drive cylinders 84 and 84*a*. Near each corner of the platen 82 (FIG. 6), in the reinforcing members 83 are secured four platen guide shafts 86–86*c*. These guide shafts pass through bushings in the vertically movable frame 52 thereby maintaining the platen 82 in a stable position as determined by the piston extension or retraction of platen drive cylinders 84 and 84*a*.

A pair of major flap pre-break slotted folding arms 88 and 88*a* are provided for effecting a preliminary fold of the major flaps toward a closed direction. Each pre-break folding arm is pivotally anchored at one end to a bracket 53 on the vertically movable frame 52. Each such arm is also pinned through an elongated slot to a respective platen bracket 55, 55*a*. By this construction, downward platen movement causes each pre-break folding arm 88, 88*a* to move arcuately from a near horizontal position to a more vertically oriented position thereby urging each major flap toward a closed position.

With specific reference to FIG. 2, there is shown each member of the bifurcated frame 12 with the minor flap folding arm 16 pivotally mounted therebetween. The folding arm axle shaft 26 is maintained laterally immovable by the minor flap folding arm axle sleeve 27 being fixed to the axle shaft 26 by a quick release pin 29, or other suitable means.

With brief reference to FIG. 6, there is shown the platen 82 in its downwardmost position resting on the top of case 20. The platen includes a pair of opposed open slots 92, 92*a* to accommodate the movement of respective pre-break folding arms 88, 88*a*. A respective slot 94, 94*a* is formed in the platen in alignment with each minor flap folding arm 16, 16*a*, to accommodate the movement therein of these folding arms. The platen 82 is then able to hold the major flaps down in contact on the minor flaps which are in turn supported upwardly by each folding arm 16, 16*a*. This unique structure permits the glue which, in the preferred embodiment of the invention, has been applied to the minor flap outer surfaces, to adhere the top major and minor flaps together. The problem of unsupported minor flaps falling into the case, and thus not being glued to the major flaps, is thereby obviated.

Figure 3:
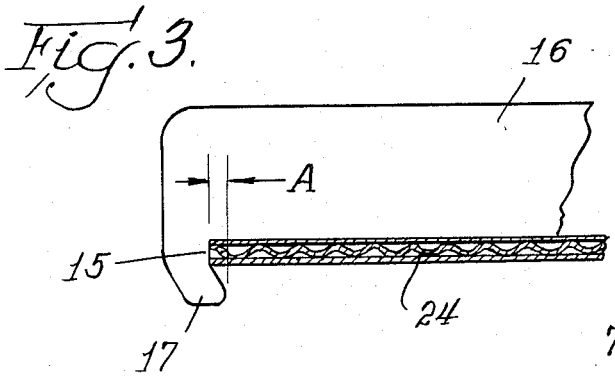
FIG. 3 is a segmented side view of a portion of a minor flap folding arm illustrating the engagement of the hook projection at the end of the arm with the edge of a minor flap.

According to the preferred embodiment, FIG. 3 illustrates the minor flap edge engagement means as a hook-like projection 17 depending from the end of the folding arm. The inward concave part of the hook 15 is structured to generally conform with the edge of the case flap 24. The projection 17 is sufficiently hooked to engage the flap edge and prevent vertical movement of the flap when so engaged. The hook edges are smoothly contoured so as not to puncture or gouge the contents of the case.

Figure 3A:
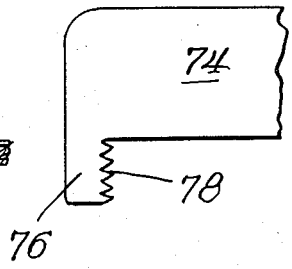
FIG. 3*a* illustrates another embodiment of the minor flap folding arm employing a depending projection with a sawtooth edge for engaging the edge of the minor flap.

FIG. 3*a* depicts another embodiment of a folding arm end 74 with a depending projection 76 employing a sawtooth 78 or barb-like edge, rather than the concave hook, for penetrating the corrugated edge of a flap. With this form of engagement means the teeth 78 become enmeshed into the edge of the flap and thus the folding arm 74 is capable of supporting the flap at its outer edge. No machine structure or functions, other than the folding arm end itself, need be modified to incorporate the sawtooth 78 engaging means.

Figure 4A:
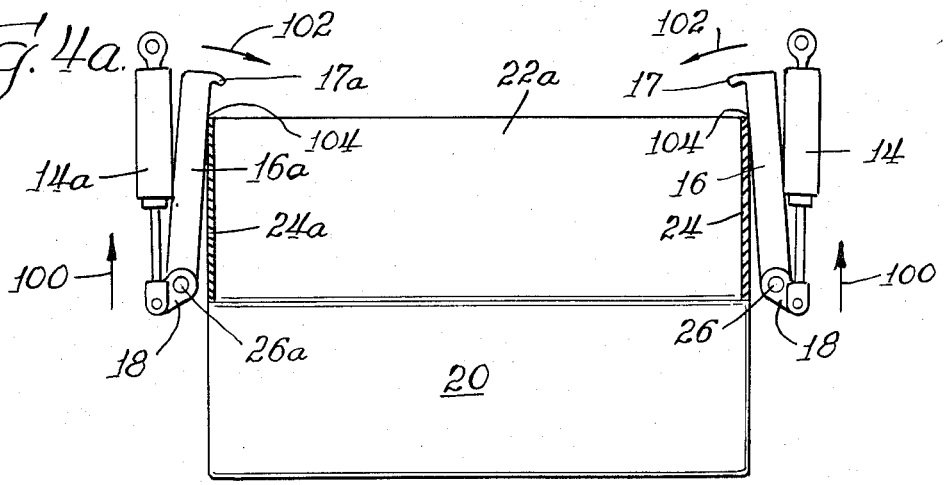
FIGS. 4*a*–4*c* are a sequence of simplified views, showing the progressive steps of the minor flap folding arms in folding such flaps to a closed position and holding them in that position.
Figure 4B:
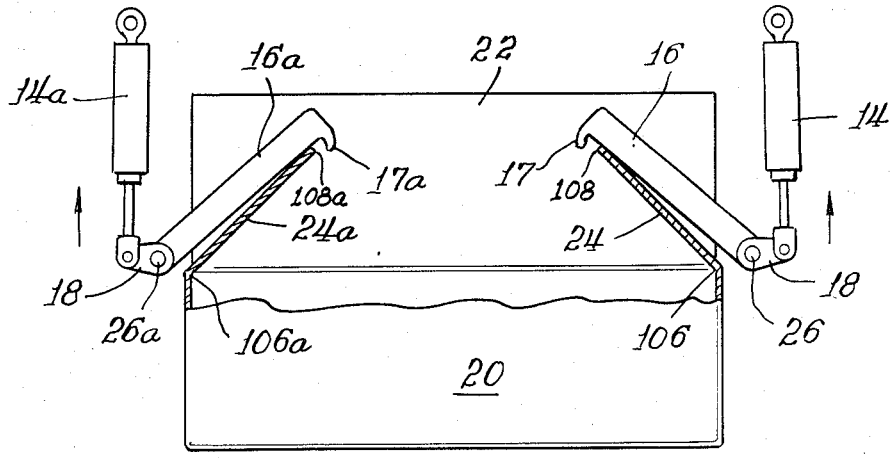
Figure 4C:
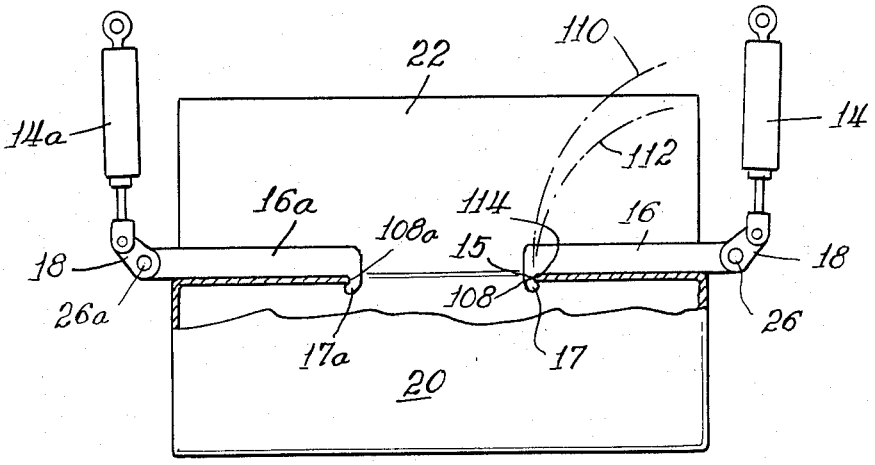
Figure 7:
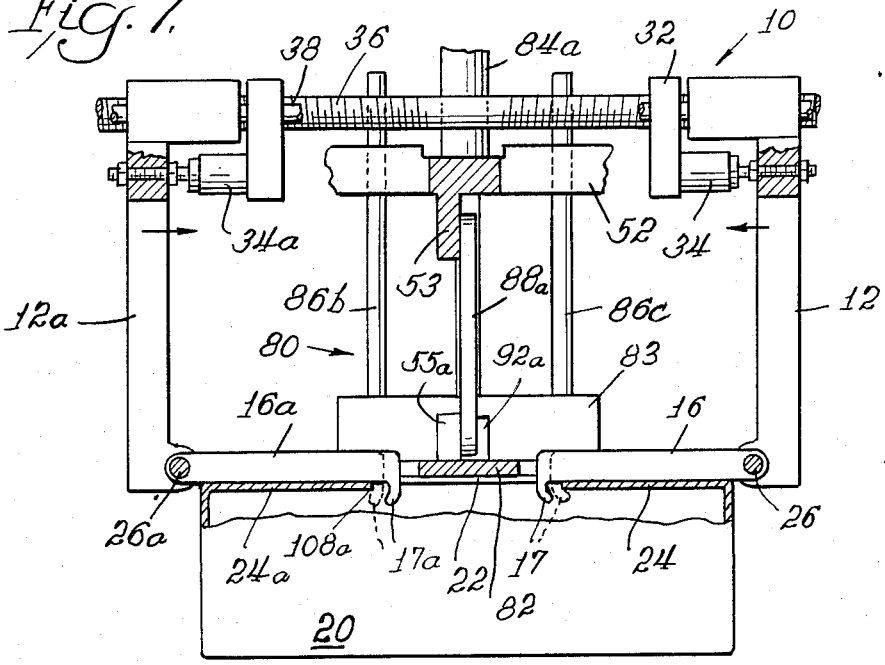
FIG. 7 illustrates the minor flap folding arms laterally moved to a position to become disengaged from the respective edges of the minor flaps.

FIGS. 4*a*–4*c* illustrate the fashion in which the hooked projection 17 engages the flap edge. FIG. 7 illustrates how it is released therefrom. The sequence of steps illustrated in FIGS. 4*a*–4*c* show the minor flap folding arms 16, 16*a* moving from initial vertical positions to final horizontal positions, thereby folding the minor flaps 24, 24*a* to closed positions.

In FIG. 4*a*, the pistons of both folding arm cylinders 14, 14*a* are being retracted in the direction of arrows 100 thereby pivotally moving both minor flap folding arms 16, 16*a* in the direction of arrows 102. In this arcuate movement, the folding arms 16, 16*a* make initial contact with the outer edges of each respective minor flap 24, 24*a* at points 104 on the folding arm bottom edges. The pivotal movement of the folding arms and the contact thereof with the flap outer edges causes such flaps to be pivotally moved to a closed position spanning the top of the case 20.

FIG. 4*b* shows the position of the folding arms 16, 16*a* moved to a more horizontal position. Because each minor flap folding arm is pivoted about its respective journaled axle 26, 26*a*, and the minor flaps 24, 24*a* are pivoted about their respective hinge points 106, 106*a*, the outer edge of each such flap moves along the bottom edge of its respective folding arm toward the concavity of the hook-like projection 17.

In FIG. 4*c*, it is seen that the piston of each folding arm cylinder 14, 14*a*, is fully retracted and each folding arm 16, 16*a* has completed the folding of each respective minor flap to a closed horizontal position. As discussed in further detail below, the minor flap folding assemblies 10, 10*a* are vertically adjustable to accommodate a particular height of case so that, in the horizontal position each folding arm 16, 16*a* is suspended closely over the top of the case 20.

FIG. 4*c* also shows that the outer edge 108, 108*a* of each minor flap at this stage of the operating cycle has moved into engagement within the concavity of its respective hook 17, 17*a*. Each minor flap folding arm 16, 16*a* is maintained in this horizontal position by its respective cylinder 14, 14*a*, and thus supports each minor flap 24, 24*a*, while the case top closing apparatus commences folding the major flaps 22 with the structure illustrated in FIGS. 5*a*–5*d*.

Each minor flap folding assembly 10, 10*a* is also horizontally adjustable. While this feature will be discussed in detail below, it is significant to note with reference to FIGS. 1 and 4*c* that each case 20 is laterally constrained in the conveyor transport 50 and the minor flap folding assemblies 10, 10*a* are laterally adjusted so that when the folding arms 16, 16*a* are horizontal, the minor flap edges 108, 108*a* fit snugly into the concavity of the respective hook-like projections 17, 17*a*.

It is also important to note in FIG. 4*c* the arcs traversed by the folding arm hook concavity 15 and the outer edge 108*a* of the minor flap 24*a*. The arcs shown in dashed lines, are designated 110 and 112, respectively. In accordance with one aspect of the present invention, the arcs 110, 112 intersect at point 114 which represents the position of hook concavity 15 when its respective arc 16*a* is in the horizontal position. As previously noted, this is the position where the outer edge of minor flap 24*a* is captured within the hook concavity. The radius of arc 110 must necessarily be greater than that of 112 in order for the folding arm hook 17*a* to engage the minor flap edge 108*a* while such arm is pivoting downwardly to a horizontal position. Through experimentation and practice, it has been found that folding arms having an arc radius of about $7\frac{1}{8}$ inch are adequate to fold minor flaps having an arc radius of about 6 inches. It should be realized that if the length of folding arm 16*a* were equal to the length of the flap to be folded, the flap outer edge may not become engaged within the concavity or the hook might tear into the outer edge in completing its pivotal movement downwardly. Therefore it is not enough that each minor flap folding arm be horizontally adjustable to accommodate cases of various minor flaps dimensions, but also the folding arms must be sufficiently longer than the length of the flap measured to its outer edge. Accordingly, the minor flap folding arms are replaceable and must be changed when a case with a minor flap length falling outside the pertinent range is to be sealed. This is quickly accomplished by removing two quick release pins, one in the clevis arm 18 and one in the folding arm sleeve 27 and then simply removing the shaft 26.

Figure 5A:
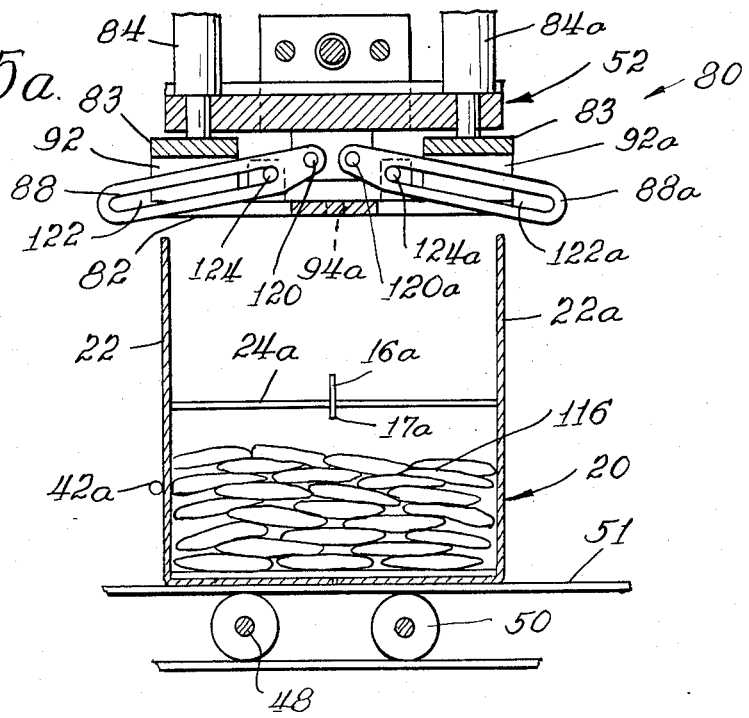
FIGS. 5*a*–5*c* are a sequence of views, again much simplified, showing the progressive steps of the major flap folding assembly in folding such flaps to a closed position over the minor flaps.
Figure 5B:
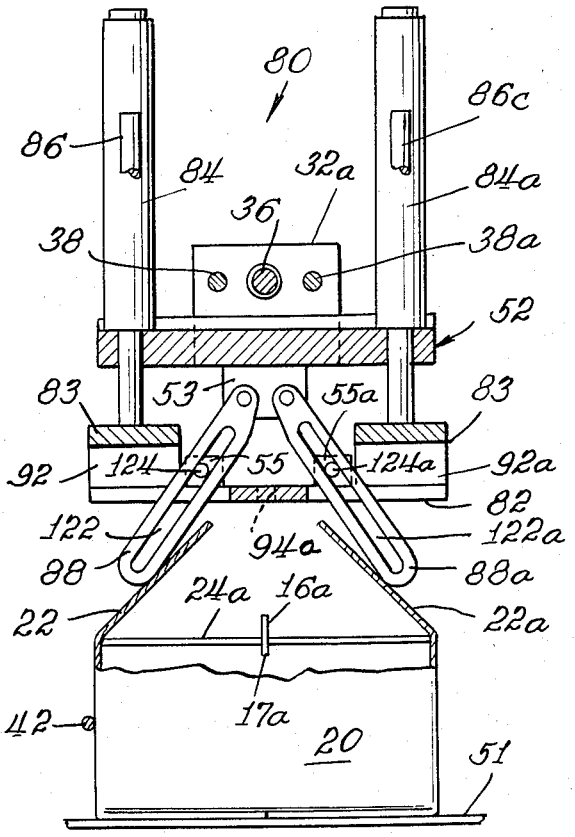
Figure 5C:
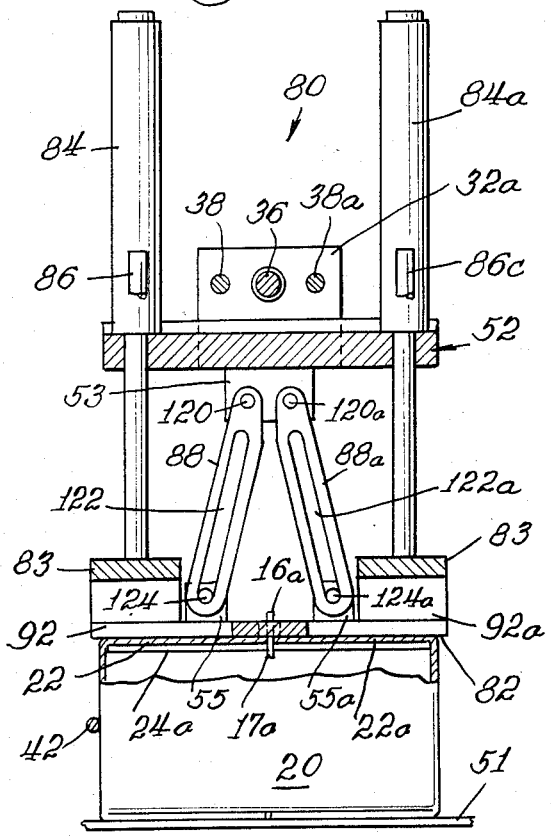

The major flap folding operations illustrated in FIGS. 5*a*–5*c* are simplified drawings taken as generally viewed from FIG. 2, with the minor flap folding assembly 10 removed for clarity. It is seen in FIGS. 5*a*–5*c* that the minor flaps have been folded to a closed position and are supported in that position, as hereinbefore described, by the hook-like projections of the minor flap folding arms. Also noted in these figures are the loosely-packed goods 116 which partially fill the case 20. Because of this, the minor flap edges must be supported vertically so that pressure applied on the top surfaces thereof will not force the minor flaps into the case and thereby prevent an effective adhesive seal between the major and minor flaps. FIGS. 5*a* and 5*b* also show that the hook-like projections 17 on the arms 16, 16*a* do not interfere with the goods 116 within the case 20.

With specific reference now to FIG. 5*a*, the pistons of platen drive cylinders 84, 84*a* are initially retracted to thereby hold the platen 82 in its upper-most position above the case 20. The piston 42 of the conveyor cylinder 40 is extended such that the case 20 is stopped on the conveyor at a position directly under the major flap folding assembly 80.

Each pre-break folding arm 88, 88*a* is journaled at one end by a respective pin 120, 120*a* fixed to a movable frame bracket 53. Each pre-break folding arm 88, 88*a* additionally includes an elongate closed slot 122, 122*a* for slidably guiding another set of pins 124, 124*a*, which slot pins are fixed to a respective platen bracket 55, 55*a*. It is thus seen that each pre-break folding arm 88, 88*a* is spatially fixed, but pivotal about its respective pins 120, 120*a*. It can further be seen from FIGS. 5*a*–5*c* that the downward movement of the platen 82 away from the frame 52, occasioned by the extension of the drive cylinder 84, 84*a* pistons, moves the pins 124, 124*a* downwardly. The slot pins drivingly engage the arm slots so as to slide in the slots and thereby pivot the pre-break folding arms 88, 88*a* from a near horizontal position to a near vertical position. Since the upright major flaps 22, 22*a* of the case 20 are directly beneath a respective folding arm 88, 88*a* each major flap is folded inwardly to a partially closed position (FIG. 5*b*).

By the use of the pre-break folding arms pinned in the fashion shown, the relative vertical movement of the platen 82 with respect to the frame 52 is transformed into pivotal motion of the pre-break arms 88, 88*a*. The platen drive cylinders 84, 84*a*, when extended in the direction shown by the arrows, drive the platen downwardly to press the major flaps 22, 22*a* in contact with the supported minor flaps 24, 24*a*, as shown in FIG. 5*c*. When the pistons of drive cylinders 84, 84*a* are fully extended, the pre-break folding arms 88, 88*a* do not extend beyond the lower surface of the platen 82 and thus the platen itself is the mechanism for firmly pressing both major flaps onto the previously glued minor flaps. The platen 82 is able to descend fully down onto the folded case top without interference with the minor flap folding arms 16, 16*a* because of the open slots 94, 94*a* within the platen 82. As seen in FIG. 5*c* and FIG. 6, such slots are of sufficient width and length to accommodate therein the respective folding arm.

In accordance with one feature of the invention, there is shown in FIG. 7 the manner in which each minor flap folding arm hook 17, 17*a* is disengaged from its respective minor flap edge 108, 108*a*. To prevent the outer edge of each minor flap from being torn by the hook 17 of each upwardly moving folding arm 16, 16*a*, each such arm is first moved laterally away from the flap edge an amount sufficient for each hook to clear the outer edge of its respective minor flap. It can be seen in FIG. 3 that the lateral movement of the folding arm a distance of A away from the edge of the minor flap 24 is sufficient for the hook 17 to clear the flap edge. This distance A corresponds to the stroke of release cylinder 34, and is also directly related to the depth of the hook concavity.

In the preferred embodiment of the invention, the minor flap folding arms 16, 16*a* undergo this lateral movement toward each other while the platen 82 is in contact with the case top. It should be understood, however, that since the vertical movement of the platen 82 does not interfere with the pivotal movement of the minor flap folding arm, the lateral movement thereof also may occur simultaneously with the upward retracting movement of the platen 82.

With reference back to FIG. 1, there is illustrated the structure for laterally moving each minor flap folding arm 16, 16*a* for disengagement of the hook-like projection from the edge of its respective flap. It was noted above that the threaded bracket 32 is maintained laterally stable because of its threaded engagement with the worm drive 36. The bifurcated frame 12, on the other hand, does not engage the threads of worm drive 36 and is thus laterally slideable on the guide rods 38, 38*a*. The only fixed connection between the threaded bracket 32 and the bifurcated frame 12 is the release cylinder 34 and its piston. During the folding operation of each minor flap, the piston of release cylinder 34 is fully extended. However, when the air pressure control (not shown) supplies one inlet of release cylinder 34 with air pressure, the piston thereof is retracted an amount substantially equal to dimension A (FIG. 3) which moves the bifurcated frame 12, and thus the folding arm 16 the same distance to release the hook 17 from the outer edge of minor flap 24. Release cylinder 34*a* is comparably operated to laterally move bifurcated frame 12*a*.

As shown in FIG. 1, each bifurcated frame 12, 12*a* is movably driven by a respective release cylinder 34, 34*a*, and is also adjustably movable by the rotation of worm drive 36. Each end of the worm drive 36 is journaled for rotation in the frame 52. One end of the worm drive 38 extends through the frame for connection to the hand wheel 58. In addition, one-half of the worm drive 36 includes left-hand threads for engaging corresponding type threads in the threaded bracket 32. The other half of the worm drive includes right-hand threads for similar engagement with the threaded bracket 32*a*.

In this manner, the clockwise rotation of hand wheel 58 moves the bifurcated frames together. In initially adjusting the case top sealer, hand wheel 58 is adjusted either counterclockwise or clockwise such that the outer edge of each minor flap is snugly engaged into the respective hook 17, 17*a* when the folding arm 16, 16*a* is in a horizontal position. The worm drive 36 does not engage the major flap folding assembly 80 and thus it is not affected by the rotation of the hand wheel 58.

Each minor flap folding assembly 10, 10*a*, as well as the major flap folding assembly 80, is vertically movable by frame worm drives 56, 56*a*. The top frame member 126, 126*a* includes threads for engaging the vertical worm drives 56, 56*a*. Moreover, another hand wheel 128 is fixed to vertical worm drive 56*a* for rotation thereof. Affixed at the end of vertical worm drive 56 is a toothed sprocket 72. Hand wheel 128 includes circumferential sprocket teeth which are drivingly connected to the gear 72 by a chain means 68. The rotation of hand wheel 128 in either direction simultaneously rotates vertical worm drives 56 and 56*a* so that the major and minor flap folding assemblies can be adjusted in the vertical direction to accommodate the height of a particular case.

An upper frame plate 70 is supported to the conveyor frame 46 by way of four vertical guide shafts, one shown at 54. The sealing head guide members 126, 126*a* include bearings which are aligned for slideable movement therein on the vertical guide shafts.

In summary, it is seen that there is provided on each minor flap folding arm, means for engaging the outer edge of each minor flap so that such flaps can be supported while in a closed horizontal position so that the major flaps can be folded thereover and pressed firmly thereon. The specific embodiment disclosed herein is intended to be exemplary of the principles of the invention and is not restrictive thereof since various modifications, readily apparent to those familiar in the art, may be made without departing from the spirit and scope of the invention as claimed hereinbelow.

What is claimed is:

1. Apparatus for closing a case of the type having a first pair of opposed top flaps and a second pair of opposed top flaps, said second pair of opposed top flaps being dimensioned to define a slot between the outer edges thereof when in closed position, comprising:

means for folding each first flap inwardly to a closed position;

means for folding each second flap inwardly over and in firm contact with the surface of each folded first flap; and means for supporting each said first flap through the slot between said second flaps while in said closed position so as to prevent substantial movement thereof because of said second flaps being folded into contact therewith, whereby said first and second flaps are supported in said closed position so that the engaged surfaces of said first and second flaps are adapted to be joined to close said case.

2. The closing apparatus in accordance with claim 1 wherein said means for supporting each first flap in said closed position comprises arm means engageable with the outer edge of said first flap through said slot between said second flaps.

3. In a case folding apparatus of the type having a pair of arms for folding a respective first pair of opposed top flaps of a case inwardly to a closed position, the case being of the type having a second pair of opposed top flaps dimensioned to define a slot between the outer edges thereof when in closed position, the improvement comprising:

a pair of flap folding arms each mounted for pivotal movement so as to generate an arc with a radius R, where R is greater than the radius of the arc generated by the pivotal movement of the respective top flap of said first pair being folded by one said arm, each arm being dimensioned to fit through said slot;

means for pivotally moving each said arm about an axis in parallel alignment with the folding axis of the respective top flap of said first pair and disposed spatially such that the respective arcs of the folding arm and the respective top flap of said first pair intersect when the top flap of said first pair is in a substantially closed position; and engaging means located at the end of each said folding arm for engaging the outer edge of its respective flap as the flap is pivotally moved toward the closed position, the engagement of said outer edge with said engaging means being substantially complete when said folding arm and said respective flap are in a position such that the respective arcs traversed thereby intersect.

4. The improved case folding apparatus as set forth in claim 3 wherein said means for pivotally moving each of said arms is disposed spatially such that the bottom of the arm is parallel and in contact with the top surface of the respective flap when said flap is in said closed position.

5. The improved case folding apparatus as set forth in claim 3, wherein said engaging means comprises a hook-like projection with a concave opening generally toward the pivotal axis of the folding arm, whereby the pivotal movement of said arm in folding the respective flap to the closed position causes the outer edge of said flap to move toward and become engaged in said hook-like projection.

6. Apparatus for closing and sealing a case of the type having a pair of opposed pre-glued first top flaps and a pair of opposed second top flaps, said second pair of opposed top flaps being dimensioned to define a slot between the outer edges thereof when in closed position, comprising:

a pair of opposed arms disposed generally above and to the side of the case to be closed and pivotally mounted so that each said arm swings from a vertical position to a horizontal position to thereby fold the respective first flap to a closed position, each arm being dimensioned to fit through said slot, and each said arm further including at the distal end thereof engaging means for engaging the outer edge of the first flap so as to support such edge and prevent substantial movement thereof while in a closed position;

means for folding each second flap inwardly to a closed position in contact with the glued surface of each first flap; and means for disengaging said engaging means from the outer edge of the respective first flap so that each said arm can be pivotally swung upwardly and away from said case through the slot between said second flaps.

7. The folding apparatus as set forth in claim 6 wherein said engaging means is comprised of a hook-like projection depending from the end of each said arm, and disposed so that the outer edge of the associated first flap can be wedged into said projection.

8. The folding apparatus as set forth in claim 6 wherein said means for disengaging includes means for laterally moving each said folding arm away from the flap outer edge an amount sufficient to release such outer edge from its wedged engagement in said projection.

9. The folding apparatus as set forth in claim 6 further including:

means for adjustably moving the pivotal mounting point of each said pair of opposed arms together and apart so as to fold the first flaps of cases having different widths; and means for adjustably moving the second flap folding means so as to fold the major flaps of cases having different heights.

10. The case folding apparatus of claim 3 or 6 wherein said engaging means comprises a projection depending from the end of each arm of said pair of arms, said projection having a sawtooth edge for engaging the edge of a flap to be supported.

11. Apparatus for closing and sealing a case of the type having a pair of opposed pre-glued first top flaps and a pair of opposed second top flaps, comprising:

a pair of opposed arms disposed generally above and to the side of the case to be closed and pivotally mounted so that each said arm swings from a vertical position to a horizontal position to thereby fold the respective first flap to a closed position, each said arm further including at the distal end thereof engaging means for enaging the outer edge of the first flap so as to support such edge and prevent substantial movement thereof while in a closed position;

means for folding each second flap inwardly to a closed position in contact with the glued surface of each first flap, said folding means including a platen disposed in a plane parallel to the top surface of said case and movable over said case and into contact with said top surface, said platen further including an open slot in alignment with each said folding arm for receiving a respective folding arm when said platen is moved in contact with said top surface; and means for disengaging said engaging means from the outer edge of the respective first flap so that each said arm can be pivotally swung upwardly and away from said case.

* * * * *

UNITED STATES PATENT AND TRADEMARK OFFICE

CERTIFICATE OF CORRECTION

PATENT NO. : 4,524,560

DATED : June 25, 1985

INVENTOR(S) : James A. Goodman

It is certified that error appears in the above-identified patent and that said Letters Patent is hereby corrected as shown below:

In column 1, line 44, please delete "supporting" and substitute therefor --support--;

In column 1, line 45, please delete "operations," and substitute therefor --operation,--;

In column 4, line 15, please delete "threated" and substitute therefor --threaded--;

In column 4, line 30, please delete "asembly" and substitute therefor --assembly--;

In column 6, line 41, please delete "flaps" and substitute therefor --flap--;

Signed and Sealed this

Eighteenth Day of November, 1986

*Attest:*

DONALD J. QUIGG

*Attesting Officer* *Commissioner of Patents and Trademarks*